US012509831B2

(12) United States Patent
Whitford

(10) Patent No.: US 12,509,831 B2
(45) **Date of Patent: *Dec. 30, 2025**

(54) BARRIER SYSTEM

(71) Applicant: Meridian Rapid Defense Group, LLC, Pasadena, CA (US)

(72) Inventor: Peter Whitford, Pasadena, CA (US)

(73) Assignee: MERIDIAN RAPID DEFENSE GROUP, LLC, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/747,044

(22) Filed: Jun. 18, 2024

(65) Prior Publication Data

US 2024/0337079 A1 Oct. 10, 2024

Related U.S. Application Data

(63) Continuation of application No. 17/035,704, filed on Sep. 29, 2020, now Pat. No. 12,031,280.

(60) Provisional application No. 62/880,012, filed on Jul. 29, 2019.

(51) Int. Cl.
*E01F 13/02* (2006.01)
*E01F 13/06* (2006.01)

(52) U.S. Cl.
CPC ..... *E01F 13/06* (2013.01); *E01F 13/02* (2013.01)

(58) Field of Classification Search
CPC . E01F 13/06; E01F 13/02; E01F 13/12; E01F 13/028
See application file for complete search history.

(56) References Cited

U.S. PATENT DOCUMENTS

| | | | |
|---|---|---|---|
| 1,449,518 | A | 3/1923 | Lawson |
| 1,631,416 | A | 6/1927 | Howard |
| 2,777,227 | A | 1/1957 | Imhoff |
| 3,065,680 | A | 11/1962 | Wiedman, Sr. |
| 3,135,062 | A | 6/1964 | Guerco |
| 4,480,405 | A | 11/1984 | Ferguson |

(Continued)

FOREIGN PATENT DOCUMENTS

| | | |
|---|---|---|
| EP | 3792401 B1 | 7/2022 |
| GB | 158281 | 2/1921 |

(Continued)

OTHER PUBLICATIONS

International Search Report and Written Opinion dated Sep. 26, 2023, prepared in International Application No. PCT/US2023/027296.

(Continued)

*Primary Examiner* — Daniel J Troy
*Assistant Examiner* — Susan M. Heschel
(74) *Attorney, Agent, or Firm* — Patterson + Sheridan, LLP

(57) ABSTRACT

A barrier system is configured to stop vehicular traffic. The barrier system has a beam gate arranged between a first barrier and a second barrier. The beam gate further comprises a hollow beam having beam first end and a beam second end. A beam cable is arranged through the beam along a beam central axis. A latch assembly has a cradle assembly that is joined to the first barrier and configured to house the beam in the cradle assembly. A pivot arm is joined to the beam and the second barrier, and further has a pivot arm joined to an axle and a counterweight housing. The counterweights arranged on the counterweight housing facilitate raising and lowering the beam in order to stop vehicular traffic.

25 Claims, 7 Drawing Sheets

(56) References Cited

U.S. PATENT DOCUMENTS

| | | | |
|---|---|---|---|
| 4,630,395 | A | 12/1986 | Nasatka |
| 4,854,767 | A | 8/1989 | Sasaki |
| 4,968,177 | A | 11/1990 | Bechtold |
| 4,998,843 | A | 3/1991 | Mothe |
| 5,101,595 | A | 4/1992 | Rhoades |
| 5,145,278 | A | 9/1992 | Lohrmann |
| 5,228,237 | A | 7/1993 | Nasatka |
| 5,356,119 | A | 10/1994 | Schock |
| 5,549,410 | A | 8/1996 | Beryozkin et al. |
| 5,997,211 | A | 12/1999 | Chou |
| 6,079,904 | A | 6/2000 | Trisl |
| 6,296,234 | B1 | 10/2001 | De Boer |
| 6,679,649 | B1 | 1/2004 | Capolupo |
| 6,702,512 | B1 | 3/2004 | Reale |
| 6,767,158 | B1 | 7/2004 | Consolazio et al. |
| 6,843,614 | B2 | 1/2005 | Yodock, Jr. et al. |
| 6,886,299 | B2 | 5/2005 | Gower |
| 6,907,811 | B2 | 6/2005 | White |
| 6,962,245 | B2 | 11/2005 | Ray et al. |
| 7,083,357 | B2 | 8/2006 | Lamore |
| 7,101,112 | B2 | 9/2006 | Burns et al. |
| 7,140,802 | B2 | 11/2006 | Lamore |
| 7,172,176 | B1 | 2/2007 | Eastland |
| 7,264,417 | B1 | 9/2007 | Nasatka |
| 7,320,557 | B1 | 1/2008 | Potter |
| 7,494,112 | B2 | 2/2009 | Fromm |
| 7,819,604 | B2 | 10/2010 | Breed |
| 7,918,622 | B2 | 4/2011 | Whitford |
| 7,959,373 | B1 | 6/2011 | Brown |
| 8,215,866 | B2 | 7/2012 | Whitford |
| 10,407,852 | B2 | 9/2019 | Dickinson et al. |
| 10,900,182 | B2 | 1/2021 | Harris et al. |
| 10,941,531 | B2 | 3/2021 | Dickinson et al. |
| 2002/0182007 | A1 | 12/2002 | Yodock et al. |
| 2003/0159356 | A1 | 8/2003 | Russell |
| 2004/0089143 | A1 | 5/2004 | Gilon |
| 2005/0220536 | A1 | 10/2005 | Blair et al. |
| 2005/0254892 | A1 | 11/2005 | Yodock et al. |
| 2006/0078380 | A1 | 4/2006 | Dehart |
| 2006/0233607 | A1 | 10/2006 | Buckley et al. |
| 2007/0272911 | A1 | 11/2007 | Fromm |
| 2008/0157493 | A1 | 7/2008 | McConkey et al. |
| 2008/0223857 | A1 | 9/2008 | Palley et al. |
| 2009/0067923 | A1 | 3/2009 | Whitford |
| 2009/0092443 | A1 | 4/2009 | Friedman et al. |
| 2009/0250674 | A1 | 10/2009 | Darcy |
| 2010/0202829 | A1 | 8/2010 | Gelfand et al. |
| 2011/0271597 | A1 | 11/2011 | Wilkinson et al. |
| 2012/0168702 | A1 | 7/2012 | Fromm |
| 2015/0033628 | A1 | 2/2015 | Barwick et al. |
| 2016/0053450 | A1 | 2/2016 | Neusch |
| 2016/0160459 | A1 | 6/2016 | Orner, Jr. |
| 2017/0204575 | A1 | 7/2017 | Klein |
| 2017/0356203 | A1 | 12/2017 | Nagel |
| 2019/0226167 | A1 | 7/2019 | Gerrard et al. |
| 2019/0330812 | A1 | 10/2019 | Ptacek et al. |
| 2022/0259889 | A1 | 8/2022 | Jordan |
| 2023/0257946 | A1 | 8/2023 | Whitford |
| 2023/0349116 | A1 | 11/2023 | Whitford |
| 2024/0084531 | A1 | 3/2024 | Whitford |
| 2024/0084532 | A1 | 3/2024 | Whitford |

FOREIGN PATENT DOCUMENTS

| | | | |
|---|---|---|---|
| GB | 2178094 | A | 2/1987 |
| WO | 2006088428 | A1 | 8/2006 |
| WO | 2007040626 | A2 | 4/2007 |
| WO | 2020170282 | A1 | 8/2020 |
| WO | 2023229788 | A2 | 11/2023 |

OTHER PUBLICATIONS

International Search Report and Written Opinion dated Jul. 21, 2023, prepared in International Application No. PCT/ US2023/020291.

Carnahan Conference Paper Albuquerque New Mexico Oct. 2004 Presented by Nigel Buckley. Publication date unknown—first cited to the USPTO on Jul. 22, 2008 in U.S. Pat. No. 7,918,622.

Delta Scientific Corporation product specification for model DSC2000 Phalanx Barrier posted on Delta Scientific Website dated Oct. 11, 2006.

The Mojo Barriers Mojo Steel Barrier posted on MojoBarriers.com original date unknown. Publication date unknown—first cited to the USPTO on Jul. 22, 2008 in U.S. Pat. No. 7,918,622.

The Mi Fram Group Modular Vehicle Barrier posted on MiframSecurity.com original date unknown. Publication date unknown - first cited to the USPTO on Jul. 22, 2008 in U.S. Pat. No. 7,918,622.

L Dynamics Portable Vehicle Arresting Barrier General Dynamics advertisement original date unknown. Publication date unknown—first cited to the USPTO on Jul. 22, 2008 in U.S. Pat. No. 7,918,622?

Delta Scientific Corporation Portable Barriers:MP5000 posted on DeltaScientific.com original date unknown. Publication date unknown—first cited to the USPTO on Jul. 22, 2008 in U.S. Pat. No. 7,918,622.

Fromm Barriers, Inc., Instant Protection When the Clock is Ticking, at least as early as Sep. 2006, 2 pages.

Meridian Rapid Defense Group, Better Barriers for the 21st Century—Archer 1000 Anti-Vehicle Barrier System, The Way back Machine—https://web.archive.org/web/20090804105407/http://www.betterbarriers.com:80/products/archer1000/, at least as early as Aug. 4, 2009.

Meridian Rapid Defense Group, Better Barriers for the 21st Century—Transportation Products, The Wayback Machine—https://webarchive.org/web/20090804105417/http://www.betterbarriers.com:80/products/transportation/, at least as early as Aug. 4, 2009.

Meridian Rapid Defense Group, Better Barriers for the 21st Century—Archer 500, undated but at least as early as Mar. 27, 2014.

Meridian Rapid Defense Group, Better Barriers for the 21st Century—Archer 750, undated but at least as early as Jan. 8, 2016.

Meridian Rapid Defense Group, Better Barriers for the 21st Century—Rapid Gate, Archer Beam Gate, Archer Active Gate, The Wayback Machine—https://web.archive.org/web/20090803215738/http://www.betterbarriers.com:80/products/rapid_gate/, 2009 Meridian Rapid Defense Group, LLC, at least as early as Aug. 3, 2009.

Meridian Rapid Defense Group, Archer Beam Gate Deployment and Use. YouTube. Sep. 5, 2019. [Retrieved on Oct. 23, 2019]. Retrieved from Internet: ,URL: https://www.youtube.com/watch?v=a5EqkkAh-Dy entire video.

International Search Report and Written Opinion dated Nov. 17, 2023, prepared in International Application No. PCT/US2023/032320.

International Search Report and WriitEm Opinion dated Dec. 4 9, 2023 and prepared in PCT/US2023/020290.

Meridian Rapid Defense Group, Ventura CA Parade Protection. YouTube. Apr. 19, 2022. [Retrieved on Nov. 13, 2023]. Retrieved from internet: <URL: https://www.youtube,corn/watch?v:cOTFzLOVteBY>, entire video.

Youtube: Meridian Rapid Defense Group—Constructions Site Vehicle Barriers Adding Protection (Year: 2020).

BARRIER SYSTEM

CROSS-REFERENCE TO RELATED APPLICATIONS

This application is a continuation of U.S. application Ser. No. 17/035,704, filed on Sep. 29, 2020, which claims priority to U.S. Prov. Appl. No. 62/880,012, filed on Jul. 29, 2019, which are herein incorporated in their entirety by reference.

BACKGROUND

Field

The present invention relates to a portable perimeter defense system.

Prior to embodiments of the disclosed invention, a portable perimeter defense system was disclosed in U.S. Pat. No. 7,918,622 issued to Whitford and in U.S. Pat. No. 8,215,866 also issued to Whitford. Devices made with the technology in these patents are sold by Meridian Rapid Defense Group LLC under the trade name ARCHER® 750. The entirety of these references is incorporated by reference.

SUMMARY

A barrier system is configured to stop vehicular traffic. The barrier system has a beam gate arranged between a first barrier and a second barrier. The beam gate further comprises a hollow beam having a beam first end and a beam second end. A beam cable is arranged through the beam along a beam central axis. A latch assembly has a cradle assembly that is joined to the first barrier and configured to house the beam in the cradle assembly. A pivot arm is joined to the beam and the second barrier, and further has a pivot arm joined to an axle and a counterweight housing. The counterweights arranged on the counterweight housing facilitate raising and lowering the beam in order to stop vehicular traffic.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
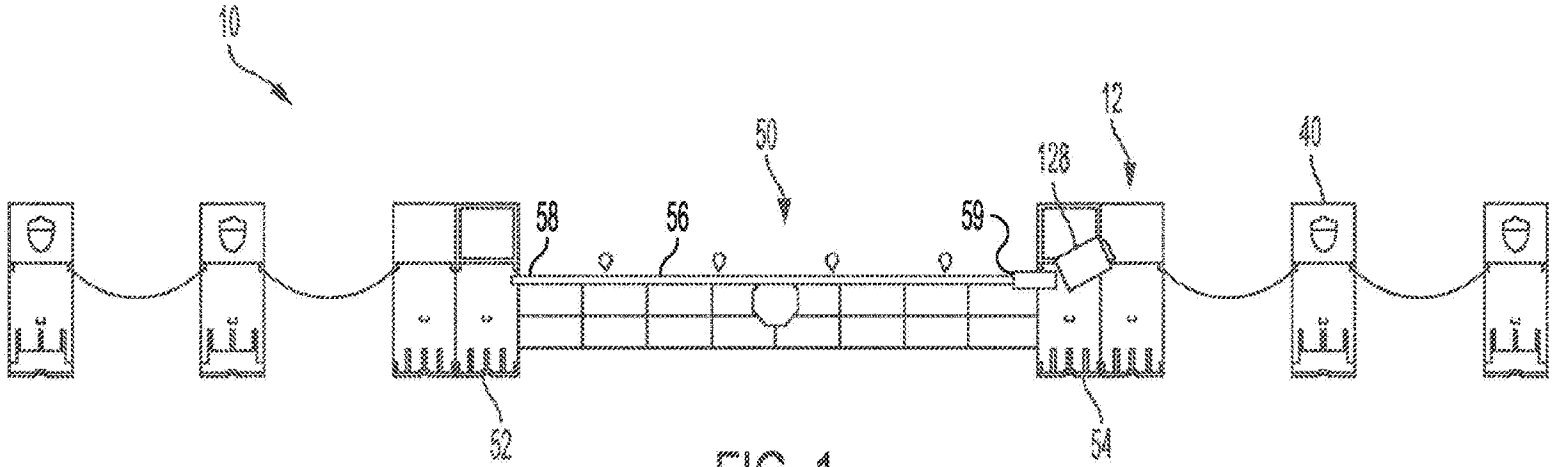
FIG. 1 shows a front view of one embodiment of the present invention shown in use.
Figure 2:
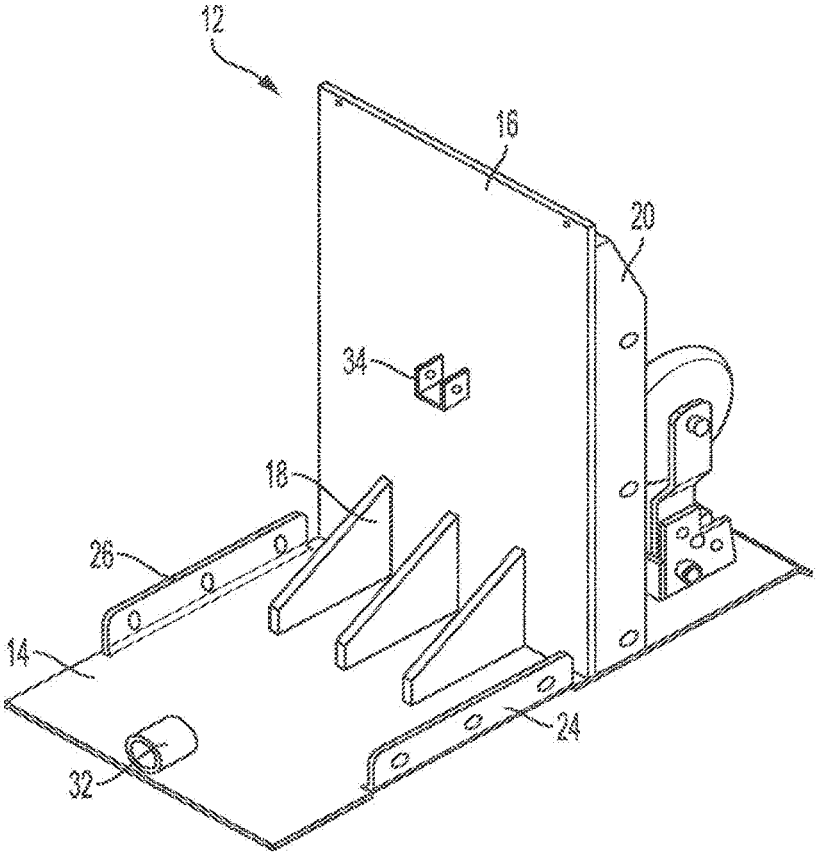
FIG. 2 shows a front detail view of one embodiment of a barrier of the present invention.

By way of example, and referring to FIG. 1, one embodiment of a barrier system 10 further comprises a plurality of barriers 12. Each barrier 12 further comprises an end plate 14 joined to a front plate 16 at approximately a right angle with a plurality of lateral supports 18, a first horizontal support 20, and a second horizontal support 22. The end plate 14 is further joined to a first attachment plate 24 and a second attachment plate 26. The front plate 16 is further attached to the end plate 14 with a gusset 28. The end plate 14 is joined to a plurality of wheels 30 and a hauler connector 32.

In some embodiments a marketing shield 40 can rest upon a marketing shield ledge 34. The marketing shield 40 can be attached to the front plate 16 with a plurality of fasteners each arranged through a marketing shield fastener opening 36.

A beam gate 50 is arranged between a first barrier 52 and a second barrier 54 as follows. The beam gate 50 further comprises a beam 56 having a beam first end 58 and a beam second end 59.

Figure 4:
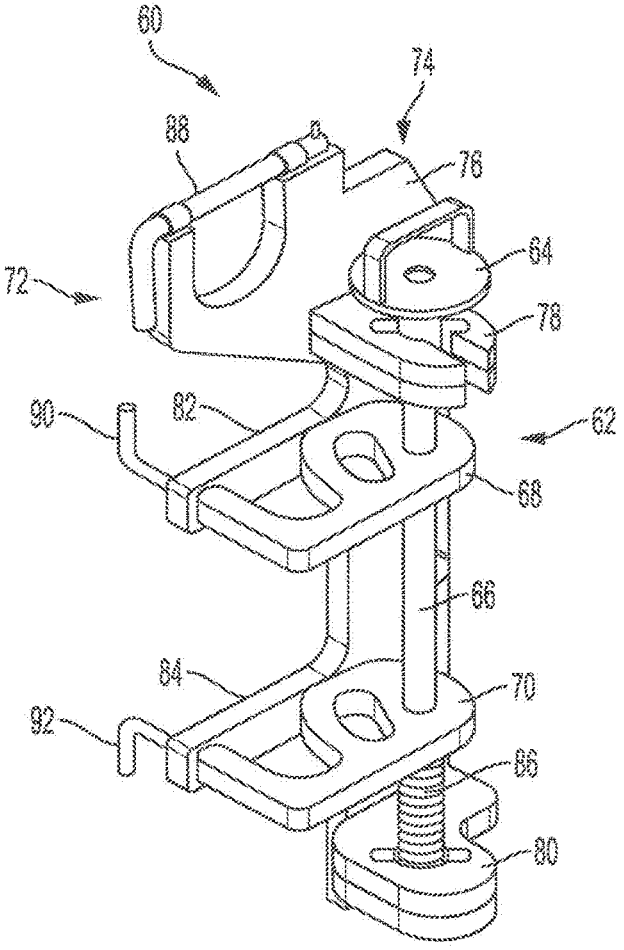
FIG. 4 shows a front perspective detail view of one embodiment of a latch assembly of the present invention.

The beam first end 58 is joined to a latch assembly 60 as shown in FIG. 4. The latch assembly 60 further comprises a locking pin assembly 62. The locking pin assembly 62 further comprises a handle 64 joined to a pin 66. The pin 66 is attached to a first arm 68 and a second arm 70. The locking pin assembly is housed in a cradle assembly 72.

The cradle assembly 72 further comprises a cradle 74 having a back plate 76 joined to an upper arm 78, a lower plate 80, a first extension 82 and a second extension 84. The locking pin assembly 62 fits through the upper arm 78 and into the lower plate 80 with a spring 86 between the second arm 70 and the lower plate 80. FIG. 4 shows the latch assembly 60 in a closed arrangement where the spring 86 is compressed the first arm 68 rotates into the first extension 82 while the second arm 70 rotates into the second extension 84. The spring 86 can stay compressed by inserting a locking pin (not shown) through the pin 66 beneath the bottom plate 80. It follows that the first arm 68 rotates away from the first extension 82 while the second arm 70 rotates away from the second extension 84 moving the latch assembly 60 into an open position.

The back plate 76 is detachably joined to a locking pin 88. The backing plate is further connected to a first hanger 90 and a second hanger 92. The first hanger 90 and the second hanger 92 can be used to hold the net as well.

Figure 5:
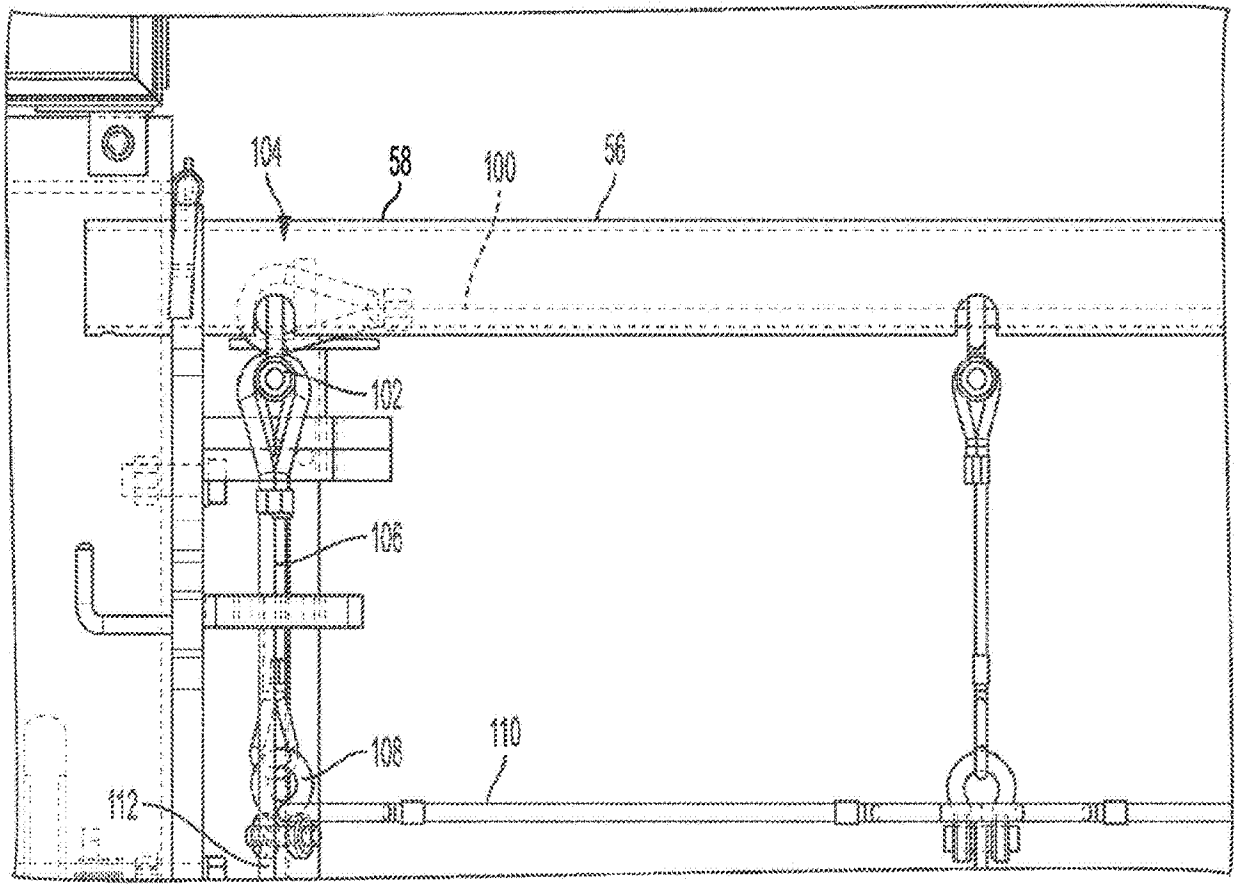
FIG. 5 shows a front detail view of one embodiment of the present invention.

Referring to FIG. 5, the beam gate 50 includes a plurality of beam cables, both horizontal and vertical cables, that are interconnected to one another to form an interconnected cable barrier beneath the beam 56 (see also FIG. 1). The beam 56 is hollow and accommodates a beam cable 100. The vertical cables may also pass through apertures provided in the hollow beam 56 and be connected to the beam cable 100. As an example, the beam cable 100 is joined to a first end first connector 102 at a beam cable first end 104. A first end first cable 106 is joined to the first end first connector 102 and a first end second connector 108. The first end second connector 108 is joined to a second cable 110 and a first end second cable 112.

The beam second end 59 of the beam 56 is joined to a pivot arm assembly 120. The pivot arm assembly 120 further comprises an axel 122 joined to a pivot arm 124. The pivot arm 124 is joined to a counterweight platform 126. The counter weight platform 126 can accommodate a counterweight 128 which can assist a user in raising and lowering the beam.

Figure 6:
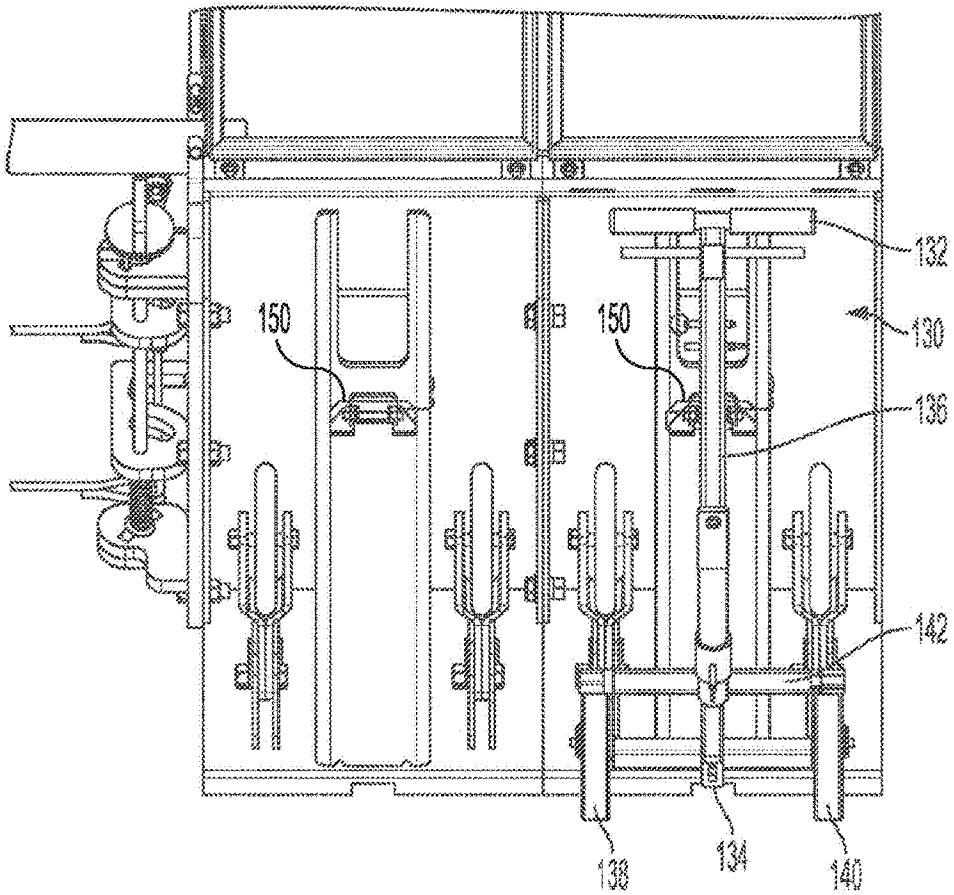
FIG. 6 shows a rear detail view of one embodiment of the present invention.
Figure 7:
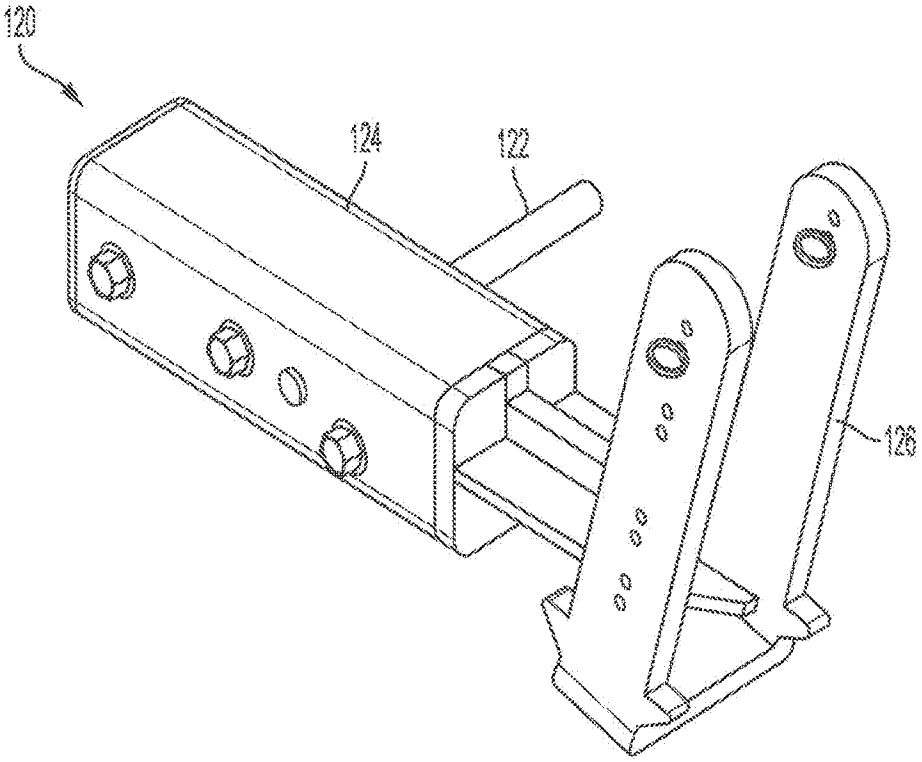
FIG. 7 shows a front perspective detail view of one embodiment of a pivot arm of the present invention.

In FIG. 6, a barrier hauler 130 can be used to maneuver each barrier 12 into a desired position. The barrier hauler 130 further comprises a hauler handle 132 joined to a hauler jack 134 with a hauler stem 136. The hauler stem 136 is further attached to a first hauler wheel 138 and a second hauler wheel 140 with a hauler axle 142.

Figure 3:
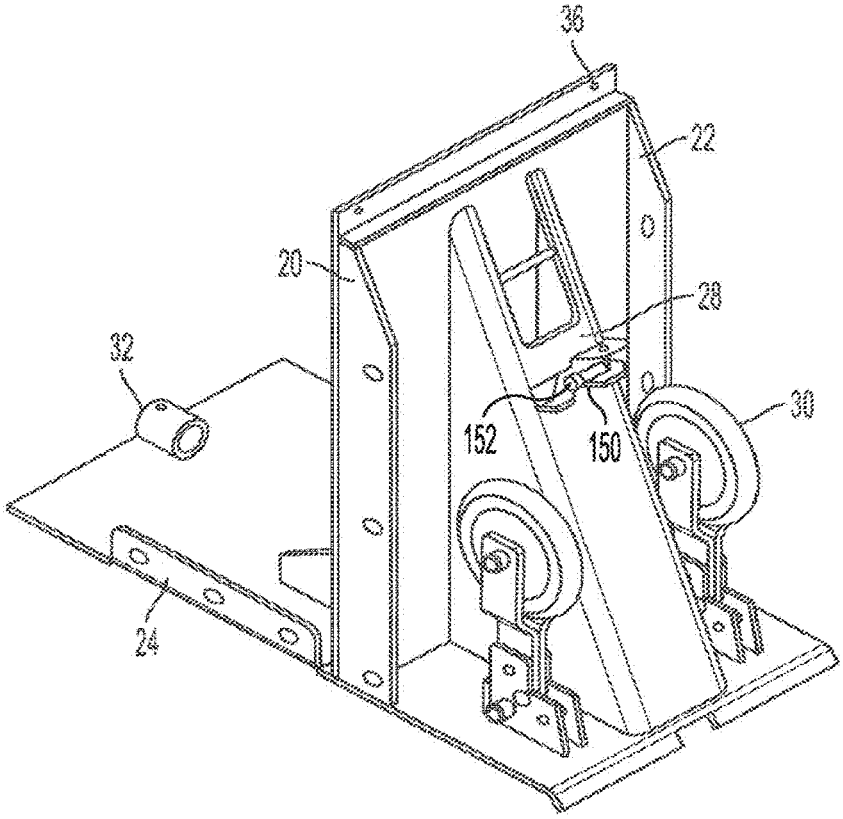
FIG. 3 shows a rear detail view of one embodiment of a barrier of the present invention.

The barrier hauler 130 can fit into a hauler storage portion 150 with a locking pin 152 (see also FIG. 3). This allows for convenient storage of the barrier hauler 130 upon moving the barrier 12.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A barrier system, configured to stop vehicular traffic, the barrier system comprising:

a beam gate, arranged between a first barrier and a second barrier, wherein the beam gate comprises a hollow beam having a beam first end and a beam second end;

a beam cable, arranged through the hollow beam along a beam central axis;

a latch assembly further comprising a cradle assembly, joined to the first barrier and configured to house the hollow beam in the cradle assembly; and a pivot arm joined to the hollow beam and the second barrier;

wherein the hollow beam is configured to be raised and lowered in order to stop vehicular traffic; and wherein the first barrier further comprises an end plate joined to a front plate with a gusset, a plurality of wheels, and a hauler connector.

2. The barrier system of claim 1, wherein the end plate is joined to the front plate at approximately a right angle with a plurality of lateral supports, a first horizontal support, and a second horizontal support.

3. The barrier system of claim 2, wherein the first barrier further comprises a first attachment plate and a second attachment plate, joined to the end plate.

4. The barrier system of claim 1, wherein the pivot arm is joined to an axle and a counterweight housing; and wherein counterweights arranged on the counterweight housing facilitate raising and lowering the hollow beam in order to stop vehicular traffic.

5. The barrier system of claim 1, wherein the latch assembly further comprises a locking pin assembly, and wherein the locking pin assembly comprises:

a handle joined to a pin; and a first arm and a second arm, joined to the pin.

6. The barrier system of claim 5, wherein the cradle assembly further comprises a cradle having a back plate joined to an upper arm, a lower plate, a first extension, and a second extension, and wherein the locking pin assembly fits through the upper arm and into the lower plate with a spring between the second arm and the lower plate.

7. A barrier system, configured to stop vehicular traffic, the barrier system comprising:

a beam gate, arranged between a first barrier and a second barrier, wherein the beam gate comprises a hollow beam having a beam first end and a beam second end;

a beam cable, arranged through the hollow beam along a beam central axis;

a latch assembly further comprising a cradle assembly, joined to the first barrier and configured to house the hollow beam in the cradle assembly, the latch assembly further comprising a locking pin assembly, the locking pin assembly comprising a handle joined to a pin, and a first arm and a second arm, joined to the pin;

a pivot arm assembly comprising a pivot arm and counterweights, the pivot arm joined to the hollow beam and the second barrier by an axle; and wherein the counterweights facilitate raising and lowering the hollow beam in order to stop vehicular traffic.

8. The barrier system of claim 7, wherein an end plate is joined to a front plate at approximately a right angle with a plurality of lateral supports, a first horizontal support, and a second horizontal support.

9. The barrier system of claim 8, wherein the first barrier further comprises a first attachment plate and a second attachment plate, joined to the end plate.

10. The barrier system of claim 9, wherein the first barrier further comprises the end plate joined to the front plate with a gusset, a plurality of wheels, and a hauler connector.

11. The barrier system of claim 7, wherein the cradle assembly further comprises a cradle having a back plate joined to an upper arm, a lower plate, a first extension, and a second extension, and wherein the locking pin assembly fits through the upper arm and into the lower plate with a spring between the second arm and the lower plate.

12. A barrier system, configured to stop vehicular traffic, the barrier system comprising:

a beam gate, arranged between a first barrier and a second barrier, wherein the beam gate comprises a hollow beam having a beam first end and a beam second end;

a beam cable, arranged through the hollow beam along a beam central axis;

a latch assembly further comprising a cradle assembly, joined to the first barrier and configured to house the hollow beam in the cradle assembly; and a pivot arm assembly comprising a pivot arm and counterweights, the pivot arm joined to the hollow beam and the second barrier by an axle;

wherein the counterweights facilitate raising and lowering the hollow beam in order to stop vehicular traffic.

13. The barrier system of claim 12, wherein an end plate is joined to a front plate at approximately a right angle with a plurality of lateral supports, a first horizontal support, and a second horizontal support.

14. The barrier system of claim 13, wherein the first barrier further comprises a first attachment plate and a second attachment plate, joined to the end plate.

15. The barrier system of claim 14, wherein the latch assembly further comprises a locking pin assembly, and wherein the locking pin assembly further comprises:

a handle joined to a pin; and a first arm and a second arm, joined to the pin.

16. The barrier system of claim 13, wherein the first barrier further comprises the end plate joined to the front plate with a gusset, a plurality of wheels, and a hauler connector.

17. The barrier system of claim 12, wherein the first barrier further comprises an end plate joined to a front plate with a gusset, a plurality of wheels, and a hauler connector.

18. The barrier system of claim 12, further comprising a locking pin assembly, wherein the locking pin assembly fits through the upper arm and into the lower plate with a spring between the second arm and the lower plate.

19. The barrier system of claim 12, wherein the pivot arm is joined to a counterweight housing, and wherein the counterweight housing comprises the counterweights.

20. The barrier system of claim 12, wherein the cradle assembly further comprises a cradle having a back plate joined to an upper arm, a lower plate, and at least one extension.

21. A barrier system and hauler kit, comprising:

a barrier system configured to stop vehicular traffic, the barrier system comprising:

a beam gate, arranged between a first barrier and a second barrier, wherein the beam gate comprises a hollow beam having a beam first end and a beam second end;

a beam cable, arranged through the hollow beam along a beam central axis;

a latch assembly further comprising a cradle assembly, joined to the first barrier and configured to house the hollow beam in the cradle assembly; and a pivot arm joined to the hollow beam and the second barrier;

wherein the hollow beam is configured to be raised and lowered in order to stop vehicular traffic; and a barrier hauler comprising:

a hauler jack joined to a handle by a stem; and a hauler axle coupled to a plurality of hauler wheels.

22. The barrier system and hauler kit of claim 21, wherein the first barrier further comprises a hauler storage portion configured to store the barrier hauler.

23. The barrier system and hauler kit of claim 22, wherein the hauler storage portion further comprises a storage pin.

24. The barrier system and hauler kit of claim 21, wherein the first barrier further comprises an end plate joined to a front plate with a gusset, and a plurality of barrier wheels.

25. The barrier system and hauler kit of claim 21, wherein the first barrier further comprises a hauler connector configured to connect with the barrier hauler.

* * * * *